United States Patent [19]

Allen et al.

[11] 4,287,981

[45] Sep. 8, 1981

[54] COLLATING MEANS

[75] Inventors: Roger A. Allen, Great Missenden; Bruce R. Inglis, Wooburn Green; Kieron P. Green, Thame, all of England

[73] Assignee: The Wiggins Teape Group Limited, Hampshire, England

[21] Appl. No.: 3,819

[22] Filed: Jan. 16, 1979

[30] Foreign Application Priority Data

Jan. 23, 1978 [GB] United Kingdom ..... 02706/78

[51] Int. Cl.[3] ..... B65G 47/26; B65G 29/00; B65G 17/46

[52] U.S. Cl. ..... 198/457; 198/480; 198/689

[58] Field of Search ..... 198/457, 489, 480, 384, 198/493; 209/535-537, 905

[56] References Cited

U.S. PATENT DOCUMENTS

| | | | |
|---|---|---|---|
| 2,837,042 | 6/1958 | Laurl, Jr. | 198/689 |
| 3,094,128 | 6/1963 | Dearsley | 198/689 |
| 3,602,357 | 2/1971 | Schubert | 198/689 |
| 3,667,587 | 6/1972 | Preston | 198/689 |

*Primary Examiner*—Robert B. Reeves
*Assistant Examiner*—Brian Bond
*Attorney, Agent, or Firm*—Shlesinger, Arkwright, Garvey & Dinsmore

[57] ABSTRACT

Means for collating a flow of rod-like elements moving in a lengthwise direction comprising a rotatable drum arranged to receive the elements on its outer surface and move them transversely to their lengthwise direction, said drum having a porous wall and being rotatable through a reception zone where a fluid bed is created on its outer surface to assist reception of the elements thereon, a holding zone where a vacuum is created to hold the elements on the drum, and a discharge zone where fluid pressure is provided to assist discharge of the elements.

12 Claims, 4 Drawing Figures

FIG. 1
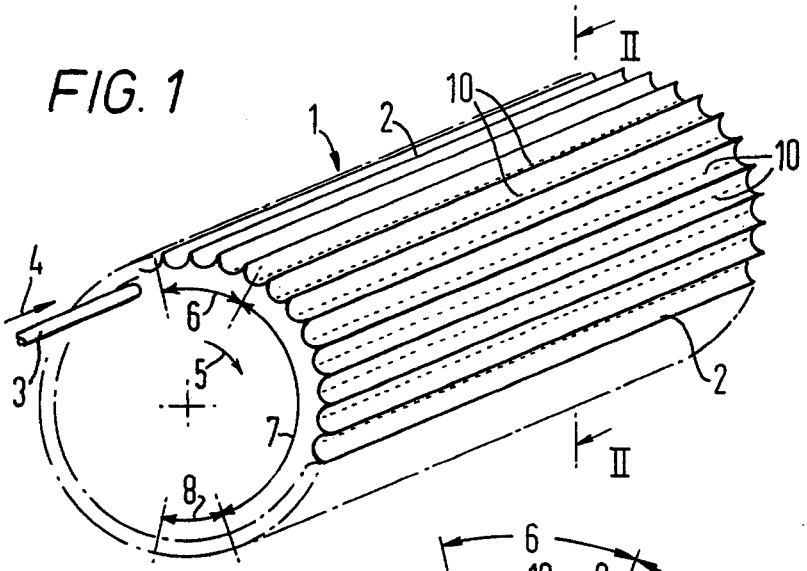
FIG. 2
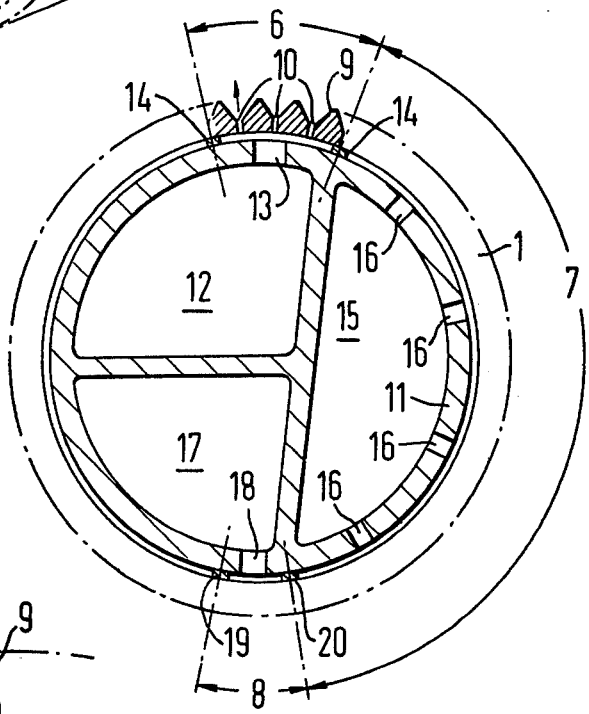
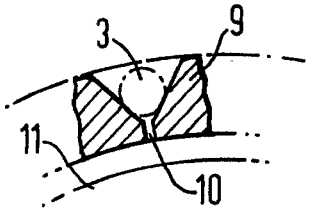
FIG. 3

COLLATING MEANS

This invention relates to means for collating a flow of rod-like elements moving in a lengthwise direction. When rod-like elements, for example material from which a cigarette filter tip is to be made, are produced and emerge from the manufacturing apparatus in a lengthwise direction it is necessary to gather them or change the direction of movement transversely to the lengthwise direction, otherwise they cannot be successfully removed from the apparatus. Various ways of moving such elements sideways have been used, for example belt conveyors but these are unsuitable if the rod-like elements are not completely rigid. If the elements are made from, for example, fibrous material which is still damp then they are fragile and movement directly onto a moving conveyor will tend to damage them. The present invention is intended to provide means for collating rod-like elements with the possibilities of damage reduced to a minimum.

According to the present invention means for collating a flow or rod-like elements moving in a lengthwise direction comprises a rotatable drum arranged to receive the elements on its outer surface and move them transversely to their lengthwise direction, said drum having a porous wall and being rotatable through a reception zone where a fluid bed is created on its outer surface to assist reception of the elements thereon, a holding zone where a vacuum is created to hold the elements on the drum, and a discharge zone where fluid pressure is provided to assist discharge of the elements.

Thus, with these means the elements can be floated onto the drum in the reception zone by the fluid bed, held on the drum by the vacuum as the drum rotates through the holding zone and then subsequently be discharged at the discharge zone, the fluid pressure acting to assist discharge and prevent the elements sticking to the surface of the drum.

In a convenient construction the drum extends axially in a horizontal direction and the reception zone is arranged on its upper part.

Preferably the discharge zone is spaced angularly around the drum by approximately 180° from the reception zone and the holding zone extends around the circumference of the drum for approximately 150°.

In a preferred construction the rotatable drum surrounds a stationary inner housing which is provided with means for supplying air under pressure to the reception and discharge zones and a vacuum at the holding zone.

Thus, the inner housing may have a first chamber with a discharge opening to the interior of the drum where it passes through the reception zone, a second chamber having a number of inlet ports opening from the interior of the drum where it passes through the holding zone and a third chamber having a discharge opening into the interior of the drum where it passes through a discharge zone, means being provided for supplying air to the first and third chambers and a vacuum to the second chamber.

In an alternative construction the inner housing may have a first chamber with a discharge opening leading to the interior of the drum where it passes through the reception zone, a second chamber opening into the interior of the drum where it passes through the holding zone and a third chamber opening into the interior of the drum where it passes through the discharge zone, means being provided for supplying air under pressure in the first and third chamber, and a vacuum in the second chamber.

The outer surface of the rotatable drum may be provided with means for guiding and locating the rod-like elements and thus the surface of the drum may be provided with longitudinally extending location channels.

The wall of the drum may be made from a porous material such as a woven synthetic plastics material or perforated sheeting but preferably the drum wall is made from a rigid non-porous material and a series of openings are provided at the base of each channel to allow the air to blow through and the vacuum to act in the various zones.

The invention can be performed in many ways but one embodiment will now be described by way of example and with reference to the accompanying drawings in which:

FIG. 1 is an isometric sketch showing the drum of the invention;

FIG. 2 is a cross-sectional view on the lines II—II of FIG. 1;

FIG. 3 is an enlarged view of part of the wall of the rotating drum; and,

Figure 4:
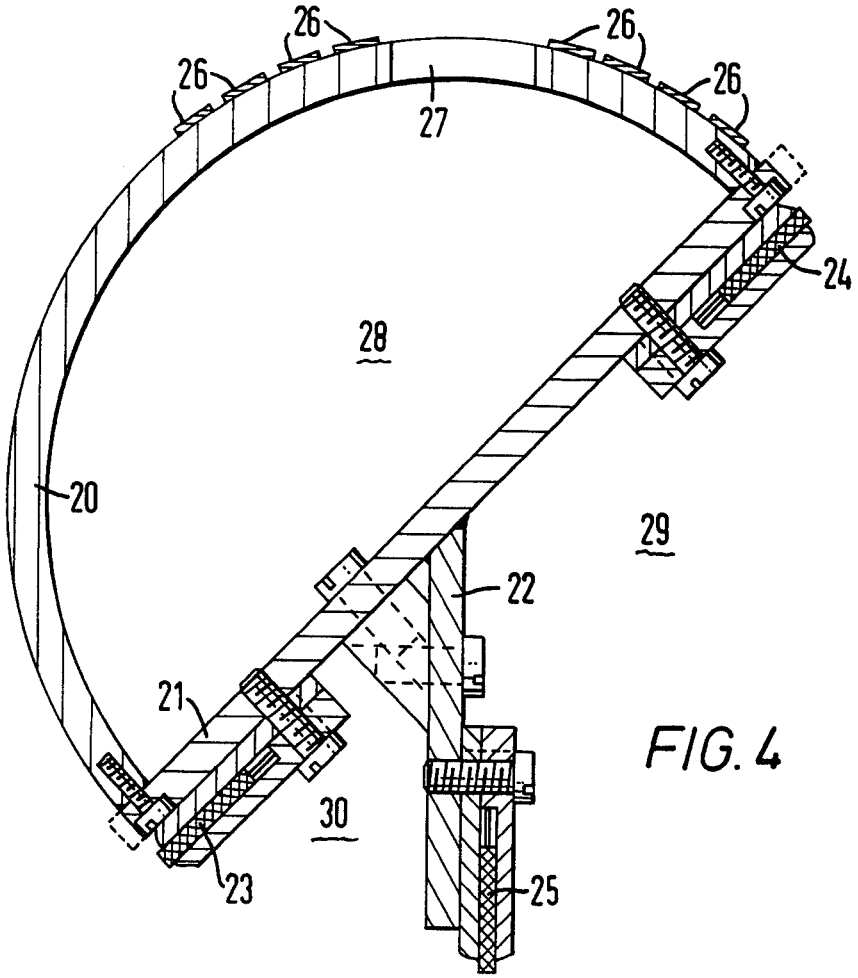
FIG. 4 is a cross-sectional view of part of an alternative construction

As shown in the drawings the collating means is intended for use with apparatus which produces a continuous flow of rod-like elements. These elements issue from the apparatus in a lengthwise direction and are made from a fibrous material. They are intended for eventual use as cigarette filter tips and when they leave the apparatus referred to above they are still in a damp and fragile condition. The intention of the collating device is to receive these rod-like elements and move them sideways, that is transverse to their direction of movement when issuing from the making machine and deposit them into reception means which might comprise a conveyor or an inclined ramp. The collating means act therefor to transfer the lengthwise movement of the elements into a transverse movement.

As shown in the drawings the collating means comprises a drum indicated by reference numeral 1 which is mounted on suitable bearings (not shown) and provided with a power operated means for causing it to rotate (again not shown). The outer surface of the drum is provided with longitudinally extending location channels 2 which act to guide and locate the rod-like elements which are indicated by reference numeral 3 in FIG. 1. The direction of movement of the elements is indicated by arrow 4 and suitable guide means (not shown) are included to ensure that the elements are directed towards the drum. Once located in one of the grooves 2 a rod like element is carried round in a clockwise direction the direction of movement being indicated by arrow 5. Means which will be described hereafter are provided so that over an area indicated by arrows 6 a fluid bed is created on the outer surface of the drum to assist reception of the elements and this area 6 is referred to as the reception zone. The holding zone is created by means of a vacuum sucking through the drum over the surface area indicated by arrow 7 to hold the elements onto the drum whilst it rotates and a discharge zone indicated by arrow 8 is provided with a fluid pressure acting outwardly through the drum to assist discharge of the elements when they reach this discharge zone.

The wall of the drum 1, indicated by reference numeral 9 in FIGS. 2 and 3 can be made from a porous material such as a woven synthetic plastics material or perforated sheeting but in the arrangement being described it is made from a non-porous material, for example aluminium, and a series of openings 10 are provided at the base of each channel 2.

The drum is arranged to extend axially in a horizontal direction so that the reception zone 6 is on its upper part. As will be seen from the drawings the discharge zone 8 is spaced angularly around the drum by approximately 180° from the reception zone 6 and the holding zone 7 extends around the circumference of the drum for approximately 150°.

As shown in FIG. 2 the rotatable drum 1 surrounds a stationary inner housing which is cylindrical and has first inner chamber 12 provided with a discharge opening 13 which leads into the interior of the drum where it passes through the reception zone 6. In order to seal the reception zone longitudinally extending seals 14 are provided at each side of the zone between the outer wall of the housing 11 and the inner surface of the wall of the drum 1. A second inner chamber 15 has a number of inlet ports 16 in the wall of the housing which again communicate with the inside of the drum where it passes through the holding zone 7 and a third chamber 17 has a discharge opening 18 into the interior of the drum where it passes through the discharge zone 8. Seals 19 and 20 are provided to seal this area between the inner surface of the wall of the drum and the outer surface of the wall of the housing. Means, not shown, are provided for supplying air under pressure to first chamber 12 and third chamber 17 and to create a vacuum in the second chamber 15. If desired the discharge openings 13 and 18 can be provided in slots.

The arrangement is such that the air under pressure in chamber 12 escapes though the discharge opening 13 and passes through the openings 10 in the wall of the rotating drum over the area of the reception zone 6 so that when the rod-like elements are directed into this zone with an endwise movement they are able to float into the grooves 2, the movement given to them being sufficient to carry them fully onto the drum. Immediately they pass from the reception zone 6 they enter the holding zone 7 where the vacuum created in the chamber acts through the openings 10 in the grooves and the elements are held in position. The rotary movement continues with the elements held as mentioned above until the elements pass into the discharge zone 8 where the air under pressure in the chamber 17 which escapes through the discharge opening 18 assists their discharge and prevents their sticking in the grooves 2.

FIG. 4 shows an alternative form of stationary housing for use in the rotatable drum 1. In this construction the housing is formed by a part cylindrical portion 20 which is connected to a central longitudinally extending plate 21. Secured to the plate 21 is a radially extending divider 22. Each end of the plate 21 carries a seal 23, 24 of similar type to the seal 25 carried on the outer end of the divider 22. Mounted on the outer surface of the portion 20 are a series of eight seals 26 four being provided on each side of a series of openings 27 which extend through the member and which are provided in a row throughout its length. If desired this series of openings could be replaced by a slot (not shown).

In use this housing is located within the wall 9 of the drum and a first inner chamber 28 is provided between the member 20 and the plate 21. A second inner chamber 29 is formed between the appropriate surfaces of the plates 21 and 22 and inner surface of the wall 9 of the drum and a third chamber 30 is again provided between the appropriate parts of the plates 21 and 22 and the adjacent portion of the inner surface of the wall 9 of the drum. Means, not shown, are provided for supplying air under pressure to the first chamber 28 and the third chamber 30 and create a vacuum in the second chamber 29. Thus the portion of the periphery of the wall 9 of the drum between the two sets of seals 26 and over the discharge opening 27 provide the reception zone 6, the portion of the periphery of the drum between the seals 24 and 25 provide the holding zone 7 and the portion of the drum between the seals 25 and 23 provide the discharge zone 8. This construction therefore works in a similar manner to that described with regard to FIG. 2 but the second chamber 29 and third chamber 30 are formed directly by the inner surface of the wall 9 of the drum thus ensuring that there is constant pressure or vacuum over the desired surfaces.

The apparatus ensures that the fragile elements are supported throughout the whole of their movement thus preventing damage and providing a smooth transition from a lengthwise movement to a collated transversely extending row. As mentioned above the elements can be delivered to an inclined plane or to a transversely moving conveyor for delivery to the next stage in their processing.

It will be appreciated that the invention can be applied to other rod-like elements which are delivered in a lengthwise direction and which require to be collated and the invention is not restricted merely to the collation of material for use with cigarette filter tips and incorporated in apparatus for making cigarette filters.

What we claim is:

1. An apparatus for collating a flow of rod-like elements moving in a lengthwise direction, comprising:

(a) a rotatable drum for receiving the rod-like elements and moving them transversely to their lengthwise direction from a reception zone located at the upper part of said drum to a discharge zone angularly spaced from said reception zone through a holding zone located between said reception zone and said discharge zone, said rotatable drum having a cylindrical wall upon the outer surface of which the rod-like elements are received, said cylindrical wall having means throughout the area of said cylindrical wall for permitting fluid flow through said cylindrical wall;

(b) means for supplying a fluid flow radially outwardly and upwardly through said cylindrical wall throughout the area of said reception zone to create a fluid bed at said reception zone for assisting the reception of the rod-like elements on said drum;

(c) means for supplying a fluid flow inwardly through said cylindrical wall at said holding zone whereby a vacuum is created for holding the rod-like elements on said drum; and, (d) means for supplying a fluid flow outwardly through said cylindrical wall at said discharge zone for assisting the discharge of the rod-like elements.

2. The apparatus of claim 1 wherein the axis of said drum extends horizontally.

3. The apparatus of claim 1 or 2 wherein said discharge zone is spaced angularly around said drum by approximately 180° from said reception zone and said holding zone extends around the circumference of said drum for approximately 150°.

4. The apparatus of claim 1 and including a stationary inner housing surrounded by said rotatable drum, said stationary inner housing including said reception zone fluid flow supplying means, said discharge zone fluid flow supplying means and said holding zone fluid flow supplying means.

5. The apparatus of claim 1 and including a stationary inner housing surrounded by said rotatable drum, said stationary inner housing, comprising:

(a) a first chamber having a discharge opening leading to the interior of said drum at said reception zone;

(b) a second chamber having a number of inlet ports opening from the interior of said drum at said holding zone; and, (c) a third chamber having a discharge opening into the interior of said drum at said discharge zone.

6. The apparatus of claim 1 and including a stationary inner housing surrounded by said rotatable drum, said stationary inner housing comprising:

(a) a first chamber having a discharge opening leading to the interior of said drum at said reception zone;

(b) a second chamber opening into the interior of said drum at said holding zone; and, (c) a third chamber opening into the interior of said drum at said discharge zone.

7. The apparatus of claim 1 wherein said outer surface of said cylindrical wall has means for guiding and locating the rod-like elements.

8. The apparatus of claim 1 wherein said outer surface of said cylindrical wall has longitudinally extending channels.

9. The apparatus of claim 8 wherein said cylindrical wall is made from a non-porous material having a series of openings through said cylindrical wall at the base of each said channel.

10. The apparatus of claim 1 wherein said cylindrical wall is made from a porous material.

11. The apparatus of claim 10 wherein said cylindrical wall is made from a woven synthetic plastics material.

12. The apparatus of claim 10 wherein said cylindrical wall is made from perforated sheeting.

* * * * *